US005087182A

United States Patent [19]

Zimmern et al.

[11] Patent Number: 5,087,182

[45] Date of Patent: Feb. 11, 1992

[54] CASING CONSTRUCTION FOR SCREW COMPRESSION/EXPANSION MACHINES

[75] Inventors: Bernard Zimmern, 302 Strawberry Hill Ave., Norwalk, Conn. 06851; Jean L. Picouet, Bridgeport, Conn.

[73] Assignee: Bernard Zimmern, Norwalk, Conn.

[21] Appl. No.: 629,172

[22] Filed: Dec. 19, 1990

Related U.S. Application Data

[63] Continuation of Ser. No. 431,592, Sep. 12, 1989, abandoned.

[51] Int. Cl.[5] ..... F04C 18/20

[52] U.S. Cl. ..... 418/195

[58] Field of Search ..... 418/195, 270

[56] References Cited

U.S. PATENT DOCUMENTS

| | | | |
|---|---|---|---|
| 3,180,565 | 4/1965 | Zimmern | 418/195 |
| 4,227,867 | 10/1980 | Whitehill et al. | 418/195 |
| 4,475,877 | 10/1984 | Zimmern | 418/195 |
| 4,484,872 | 11/1984 | Ohtsuki | 418/195 |
| 4,747,755 | 5/1988 | Ohtsuki et al. | 418/195 |

*Primary Examiner*—Richard A. Bertsch
*Assistant Examiner*—David L. Cavanaugh
*Attorney, Agent, or Firm*—Finnegan, Henderson, Farabow, Garrett & Dunner

[57] ABSTRACT

A machine for the compression or expansion of a fluid comprising a multi-thread screw having opposite low and high pressure ends, the screw being mountable for rotation about an axis to cooperate in substantially fluid-tight manner in a cylindrical bore of a stationary casing, at least one pinion having teeth disposed for meshing engagement with the screw threads and rotatable about an axis transverse with respect to the axis of screw rotation. The screw is carried by a shaft supported by two sets of bearings respectively disposed on each end of the screw. The casing bore is open at both ends and the high pressure end of the casing includes a hoop having an internal bore diameter substantially smaller than the diameter of the bore. The low pressure end of the casing bore is of a diameter at least equal to the diameter of the screw for introduction of the screw into the casing bore during assembly of the screw and casing.

2 Claims, 1 Drawing Sheet

Fig. 1
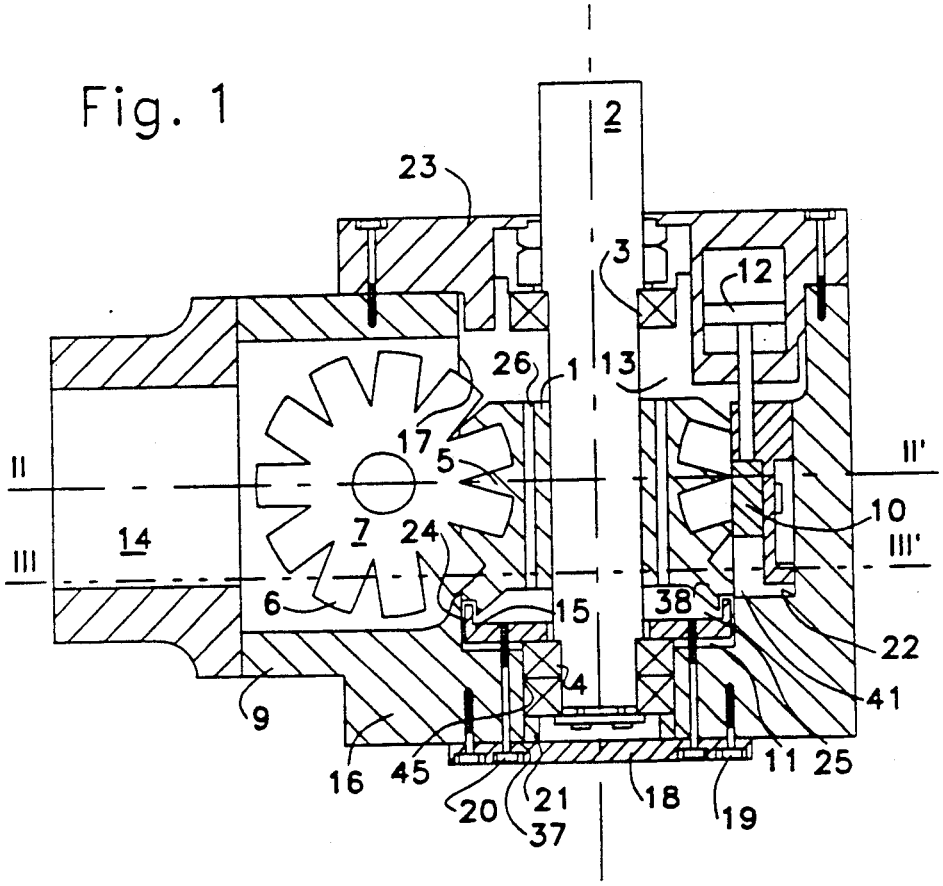
FIG. 2
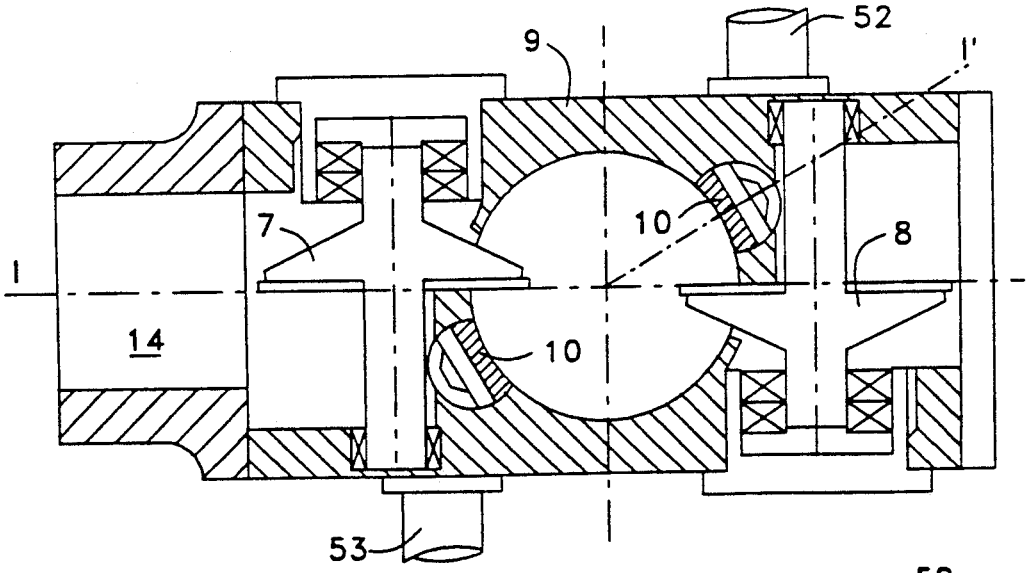
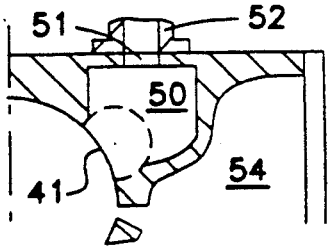
Fig. 3

CASING CONSTRUCTION FOR SCREW COMPRESSION/EXPANSION MACHINES

This application is a continuation, of application Ser. No. 431,592, filed Sept. 12, 1989, now abandoned.

It is known to build compressors or expansion machines using a screw cooperating with at least one gate-rotor. Such machines have been described in U.S. Pat. No. 3,180,565, for example. These machines have been now widely used for more than twenty years and produced by nearly a dozen different manufacturers.

The most popular design has been one including a cylindrical screw cooperating with one or two planar gate-rotors.

Although FIG. 5 of U.S. Pat. No. 3,180,565 illustrates a casing and end cap construction by which the screw may be introduced from the low pressure side of the machine, all machines made for the past several years have had casings where the screw is introduced into the casing from the high pressure side.

A first reason for this latter approach to screw/casing assembly is that the construction of FIG. 5 in the aforementioned patent, which shows a blind bore on the high pressure end of the casing, implies that the bearings, by which the screw is located axially, cannot be located on the high pressure end but rather on the opposite low pressure end. Out of experience in the art, however, it is preferred to have the bearings which locate the screw axially as close as possible to the high pressure end so as to minimize relative displacement of the high pressure end of the screw groove due to thermal expansion.

A second reason is that it is very convenient to have the bearing holder movable on the high pressure end of the casing. In air compressors, it facilitates an inexpensive channel for connecting both discharge ports between the holder and the casing. In refrigeration compressors, the bearing holder portion centered in the casing bore has been used to prevent capacity control slide from rocking as shown on U.S. Pat. No. 4,075,957 and for pressure balancing purposes. This use of the centered bearing holder is not needed with slides which are angularly positioned independently of the bearing holder as shown in U.S. Pat. No. 4,571,166.

Introducing the screw into the casing by the high pressure side is nevertheless quite objectionable as this means that the bearing supporting the screw shaft on the high pressure side is not located directly by the casing but instead is located indirectly by a bearing holder. Because the bearing holder has some clearance with the casing so as to allow assembly and disassembly, the screw cannot be perfectly centered in the casing on the high pressure side without special precautions which are expensive to carry out. As a result, the clearance between the tops of the threads of the screw and the casing is increased with a corresponding loss in machine operating efficiency.

This invention relates to a machine for the compression or expansion of a fluid comprising a screw mounted for rotation about an axis and provided with multiple threads, the crests of the threads being disposed on a cylinder concentric with the axis of the screw and so arranged as to cooperate in substantially fluid tight manner with a stationary casing having a cylindrical bore which partially surrounds the rotor. At least one pinion gate-rotor, having teeth which are disposed in meshing engagement with the screw threads, is supported by the casing to rotate about an axis which is transverse with respect to the axis of rotation of the screw. At least one low pressure port is disposed in the casing on one end of the screw and a high pressure port is disposed in the casing on the opposite end in the immediate vicinity of the pinion. The screw is carried by a shaft supported by two sets of bearings respectively disposed one on each end of the screw. The cylindrical bore of the casing is open at both ends but includes an annular transverse wall to establish a reinforcing hoop on the high pressure end and the bore is open for introduction of the screw on the low pressure end.

Several advantages are obtained from the aforementioned construction.

First, whereas the screw in prior designs could be perfectly centered in the casing on the low pressure side but not on the high pressure side and therefore resulting in minimal radial clearances between the screw and the casing on the low pressure side but in larger clearances on the high pressure side, the opposite is true of the invention with substantially improved efficiency since clearances have much more effect on leakage on the high pressure side than on the low pressure side.

Second, it has been found that the provision of a hoop to carry the high pressure end bearing reinforces the rigidity of the casing on the high pressure side and that deformation of the casing bore due to pressure and also thermal distortion is substantially reduced, thereby allowing the bore to stay more circular or to become less oval and thus further reducing the radial screw casing clearance on the high pressure side. This is especially true of refrigeration compressors in which plenum chambers are provided in the region immediately following the discharge ports for noise reduction purposes. In an oil free, liquid flooded compressor, the plenum chambers are at condensing temperature whereas most of the casing is at suction temperature, thereby contributing significantly to distortion of the casing and of the circular screw receiving bore. As a result of the annular flange-like hoop of the present invention, such distortion is substantially reduced. On a refrigeration compressor operating on R22 with suction temperature in the range of from 0° to −20° Centigrade, and discharging around 40° C., measurements have shown ovalization of the casing i.e., the difference between the smaller and larger diameter on the high pressure end of the bore to be reduced by around 40%.

Third, when slides are used to control capacity of the compressor as shown for instance on U.S. Pat. No. 4,074,957, the gutters made in the casing to carry the slide, for obvious manufacturing reasons, have to be machined from the end of the casing through which the screw is introduced, that is, the high pressure end in the prior art. This means that the gutter, having high pressure gas, exists in the area where the screw end and where a sealing ring as described in U.S. Pat. No. 4,475,877 is installed. This means that there can be no space left between this sealing ring and whatever parts close the bore, whether the bearing holder or the hoop defining portion of the casing. If indeed a space is left, high pressure gas enters into and can easily leak all around the sealing ring and the casing, which reduces considerably the efficiency.

As the sealing ring has to be axially located precisely vis-a-vis the screw and as the screw itself has to be axially located precisely in the casing with shims, the shims have to be installed between the high pressure seal and the bearing holder or between the bearing holder and the screw. As a result, the screw has to be assembled first in the casing, the proper location defined and the desired shim defined. The screw must then be disassembled and reassembled with the correct shim.

By introducing the screw from the low pressure side, it is possible to machine the gutter for the slide from the same side and stop them short of the area where the sealing ring is installed, thereby preventing the high pressure from reaching the area between the sealing ring and the casing hoop backing it.

It is then possible to install the shim locating the screw on the outside of the assembly which is reachable without disassembly of the screw. There is a slot between the sealing ring, slot created by the need to allow some axial relative displacement of the screw and seal vis-a-vis the casing, but the high pressure does not reach it.

In the accompanying drawings, in which like parts are designated by like reference characters:

FIG. 1 is a cross section on line I—I' of FIG. 2;

FIG. 2 is a cross section on line II—II' of FIG. 1; and

FIG. 3 is a partial cross section on line III—III' of FIG. 1 at a slightly reduced scale.

A more complete understanding of the invention may be had from the following description of a preferred embodiment of a compressor incorporating the invention and illustrated in the drawing.

In FIG. 1, a screw mounted on a shaft 2 rotatably supported by bearings 3 and 4 has threads 5 engaging the teeth 6 of two symmetrical gate-rotors 7 and 8. The screw and the gate-rotor are rotatable in a casing 9. When used for operation in a refrigeration system, the casing 9 is usually equipped with one or more slides 10 preferably constructed in accordance with the teaching of U.S. Pat. No. 4,571,166. The slides 10 are axially movable by pistons 12, in turn, actuated by fluid power means such as oil pressure or discharge pressure gas.

The casing 9 has a suction or low pressure port 13 in communication with suction piping 14. Discharge ports 41 are located near the gate-rotor close to the high pressure end 38 of the screw 1. The screw 1 is sealed with respect to the casing 9 on the high pressure end 38 by a high pressure end seal 15, the details of which are shown in U.S. Pat. No. 4,475,877.

The casing 9 includes an annular wall portion or hoop 16 transverse to a main bore 17 on the interior of the casing and in which the screw 1 is rotatably positioned. The wall 16 has an exterior end face 37 against which an end plate 18 is held by bolts 19. Additional bolts 20 extend from the end plate 18 to end seal 15 to draw the end seal 15 against the bearing 4 and through a shim 21 against the end plate 18.

It can be seen from this assembly that the axial location of the screw 1 is determined by the thickness of the shim 21 and that this shim can be changed at will without disassembly of the screw from the casing 9, simply by removing the end plate 18. It can be seen also that to facilitate such axial adjustment of the screw 1, a clearance space 11 exists between the high pressure seal 15 and the wall 16.

It can be seen also that a gutter 22, in which the slide 10 is received, ends at an axial location spaced from the clearance space 11 between the seal 15 and the inner surface of the casing end wall 16. This would not be the case if the gutter 22 had to be machined from the high pressure side or if the wall 16 was on the low pressure port side and the bearing holder (carrying the bearing 3) was placed, as in the conventional technology, on the high pressure end of the bore 17. This latter condition in conventional machines would introduce high pressure to the clearance space 11 and leaks would occur in the space 24 between the high pressure seal and the casing, around the seal and damage the efficiency. Furthermore, the high pressure seal 15 would be subject on one side to high pressure for the full surface of the clearance space 11 whereas the opposite side of the seal 15 is at suction pressure because the volume 25 between the end of the screw 1 and the seal 15 is connected to suction pressure by one or more holes 26 in the screw in accordance with conventional practice.

As shown in FIG. 3, the discharge port 41 communicates with a plenum chamber 50 formed in the casing 9 and which discharges high pressure gas through a hole 51 into a discharge pipe 52. An identically symmetrical plenum chamber (not shown) is provided adjacent to the gate-rotor 7 for discharging high pressure gas through a discharge pipe 53 (FIG. 2). The presence of these plenum chambers immediately behind the discharge ports serves to reduce noise due to the reduction in energy of the pulse of high pressure gas exiting each groove in the screw 1 as a result of each pulse passing to a larger volume. The provision of the plenum chambers 50 is critical to noise reduction, particularly in refrigeration and air conditioning machines. On the other hand, in the case of air conditioning compressors operating without oil injection but with injection of condensed gas in liquid form, a technique now widely applied, the chamber 50 is at condensing temperature whereas most of the casing 9, including the area 54 in FIG. 3, is at suction temperature. As a result, the casing is subjected to a large measure of thermal distortion forces tending to change the shape of the bore 17 at the high pressure end of the screw 1 from circular to elliptical.

The aforementioned thermal distortion forces are effectively resisted by the hoop 16 at the high pressure end of the casing 9. In this respect, the degree of resistance to such forces of the rigidity of the casing 9 at the high pressure end thereof is limited by the size of the through bore 45 required for access to the high pressure end of the screw 1. However, a combination of the required diameter of the bore 45 and the axial dimension of the hoop needed to receive the bearings 4 allows adequate radial cross section for the hoop 16 to achieve required rigidifying strength. For example, in a machine with a screw diameter of 140 millimeters, the outer diameter of the bearings 4 would be typically 80 millimeters to provide a radial hoop dimension the equivalent of 60% of the end surface of the bore 17. To accommodate the combined thickness of the bearings 4 and shim 21, the hoop 16 extends axially for about 40 millimeters, thus providing an adequate section in the hoop 16 to achieve the intended rigidity.

This improvement in rigidity is achieved without increase of the overall length or volume of the machine because, in the prior art, the bearing holder carried bearings the same as the bearings 4, thus necessitating the same axial dimension or thickness without using that thickness of material in any way for rigidity at the high pressure end of the casing.

From the foregoing it will be appreciated that by assembling the screw 1 into the casing 9 from the suction end of the casing 9 eliminates the need for costly disassembly to locate the screw axially.

Furthermore, it provides for the possibility of closer clearance between the outside diameter of screw 1 and the casing bore 17 and hence higher efficiency.

The bore 45 in the wall 16 in which the bearing 4 is set can be machined absolutely concentric to the bore 17 in the casing 9 as they can be machined together without disassembly. On the contrary, it is difficult to locate the bearings 3 exactly in the center of the bore 17 as they are carried by a bearing holder 23 which must have some clearance with bore 17 to be assembled and disassembled. Moreover, this clearance can be not evenly distributed so that when assembling the bearing holder 23 and the casing 9, the axis of rotation of the screw is pushed toward one side of the bore. Hence more clearance must be provided between the screw and casing on the suction side than on the high pressure side, by making the screw slightly conical, for example.

In the prior art, the same situation occurred except that there, the holder was on the high pressure side, so that the screw/casing clearance was maximum at discharge end, thereby generating much more leakage.

Furthermore, having the hoop 16 at the high pressure end of the casing gives more rigidity to the casing and prevents its distortion in the area where clearances are more critical.

In the prior example of a refrigeration compressor with screw diameter 140 millimeters, rotating at 3600, rpm compressing refrigerant R22 with compression ratio around 4, and cooled by injection of liquid refrigerant, it has been found that deformation of casing under pressure and thermal distortion was reduced by approximately 40% at the high pressure end and that this seemed to be responsible for an increase in isentropic efficiency of from 75–76% to approximately 78%.

We claim:

1. A machine for the compression or expansion of a fluid comprising a screw having opposite low and high pressure ends, said screw being mountable for rotation about an axis and provided with multiple threads, the crests of said threads being disposed on a cylinder concentric with said axis and so arranged as to cooperate in substantially fluid-tight manner with a stationary casing having a cylindrical screw receiving bore to surround said screw at least to a partial extent, at least one pinion having teeth disposed for meshing engagement with said threads and rotatable about an axis which is transverse with respect to said axis of rotation of said screw, at least one low pressure port located near the low pressure end of said screw, a high pressure port located near the opposite high pressure end of said screw in the immediate vicinity of said pinion, said screw being carried by a shaft supported by two sets of bearings respectively disposed on each end of the screw, the low pressure end of the screw receiving bore being of a diameter at least equal to the diameter of said screw for introduction of said screw into said screw receiving bore during assembly of said screw and casing and characterized in that said casing comprises a one-piece, monolithic screw enclosing portion, the material of said screw enclosing portion extending radially inward past the high pressure end of said screw receiving bore to define a hoop portion having an internal hoop bore open at one end to the casing exterior and at the other end to said screw receiving bore, the diameter of said hoop bore being substantially smaller than the diameter of said screw receiving bore, said hoop portion thereby reinforcing the rigidity of the casing against deformation in the support of bearings at the high pressure end of said screw.

2. A machine for the compression or expansion of a fluid comprising a screw having opposite low and high pressure ends, said screw being mountable for rotation about an axis and provided with multiple threads, the crest of said threads being disposed on a cylinder concentric with said axis and so arranged as to cooperate in substantially fluid-tight manner with a stationary casing having a cylindrical screw receiving bore to surround said screw at least to a partial extent, at least one pinion having teeth disposed for meshing engagement with said threads and rotatable about an axis which is transverse with respect to the axis of rotation of said screw, at least one low pressure port located near said low pressure end of said screw and a high pressure port located near the opposite high pressure end of said end in the immediate vicinity of said pinion, said screw being carried by a shaft supported by two sets of bearings respectively disposed on each end of the screw and characterized in that said casing comprises a one-piece, monolithic screw enclosing portion, the material of said screw enclosing portion extending radially inward past the high pressure end of said screw receiving bore to define a hoop portion having an internal hoop bore open at one end to the casing exterior and at the other end to said screw receiving bore, the diameter of said hoop bore being substantially smaller than the diameter of said screw receiving bore, in that the bearing set disposed on the high pressure port end of said screw is mounted by said hoop bore and that the bearing set on the low pressure end of said screw is mounted on a bearing holder fixed to the casing at the low pressure end of said screw, said hoop portion thereby reinforcing the rigidity of the casing against deformation in the support of the bearing set at the high pressure end of said screw.

* * * * *